US005405031A

United States Patent [19]

Derksen

[11] Patent Number: 5,405,031

[45] Date of Patent: Apr. 11, 1995

[54] CLOSURE FOR A MEDICINE BOTTLE

[75] Inventor: Klaus Derksen, Karlsbad-Ittersbach, Germany

[73] Assignee: Firma Pohl GmbH & Co. KG, Karlsruhe, Germany

[21] Appl. No.: 153,323

[22] Filed: Nov. 15, 1993

[30] Foreign Application Priority Data

Nov. 19, 1992 [DE] Germany ..... 42 38 983.6

[51] Int. Cl.[6] ..... B65D 41/58

[52] U.S. Cl. ..... 215/249; 215/237

[58] Field of Search ..... 215/247, 248, 249, 251, 215/364, DIG. 3, 235, 237

[56] References Cited

U.S. PATENT DOCUMENTS 3,547,297 12/1970 Herbert et al. ..... 215/249
4,562,932 1/1986 Finnern ..... 215/249
5,088,612 2/1992 Storar et al. ..... 215/247

*Primary Examiner*—Allan N. Shoap
*Assistant Examiner*—Nova Stucker
*Attorney, Agent, or Firm*—Kenyon & Kenyon

[57] ABSTRACT

A closure for a medicine bottle, the closure having a flanged cap for covering the bottle mouth and having in the region of its base a tear-out section defined by a weakened line. A cover having a front and a rear part connected by an articulation is disposed over the flanged cap. The front part attaches to the tear-out section of the flanged cap at a first attachment area. The rear part of the cover is connected to the flanged cap outside the tear-out section at a second attachment area. When the front part of the cover is lifted up, the tear-out section is removed to provide access to the bottle. If the front part is pulled even further, the entire closure can be removed with ease from the bottle, especially if weakened lines extending from the second attachment area are provided. The closure may also be developed as a medicine bottle closure with a sealing element through which a syringe may be inserted.

20 Claims, 5 Drawing Sheets

CLOSURE FOR A MEDICINE BOTTLE

FIELD OF THE INVENTION

The present invention relates generally to closures for bottles and more particularly to medicine bottle closures which have a seal through which a syringe can be inserted to extract liquid.

BACKGROUND OF THE INVENTION

A medicine bottle closure is disclosed in German application, P 41 32 896.5, which shows a flanged cap for holding down a seal over the mouth of a bottle. Also shown is an articulated cover over the flanged cap for accessing the seal. A weakened line in the base of the flanged cap is recessed in the region of the cover articulation in order to prevent an unintentional tearing-off of the flanged cap from the bottle neck when the cover is opened.

The articulation on the cover is formed by a V-shaped groove, the flanks of which preferably form an obtuse angle between 100° and 135°. In order to expose the central area of the bottle mouth, a part of the cover which has a grip is lifted until the two flank surfaces of the v-shaped groove contact each other.

If the seal which closes off the mouth is then punctured by a syringe, liquid can be removed from the medicine bottle. However, it must be recognized that since the tear line of the flanged cap does not form a closed area and is recessed in the region of the groove—and due to the formation of the groove in the plastic cover—access to the tear-out section and the seal is difficult. This is because the front part of the cover which engages the central tear-out part of the flanged cap springs back elastically in the direction of its starting position after opening. Unless held back by the person handling the bottle, the front part of the cover thus blocks part of the opening which is to be punctured by the syringe. If simple handling of the closure is desired, this arrangement is a disadvantage.

OBJECTS AND SUMMARY OF THE INVENTION

An object of the present invention is to provide a closure for a medicine bottle where that the handling of the closure is simplified.

A further object of the invention is to provide a puncture area for a syringe that remains completely open after the opening of the front cover part.

Another object of the invention is to provide a closure which allows the user to easily separate the closure parts and the medicine bottle from each other in order to be able to reuse the closure and the medicine bottle.

The present invention therefore provides a closure for a bottle comprising: a flanged cap for covering a mouth of the bottle and having a base and a flange, the base having a tear-out section defined by a weakened line; a cover disposed over the base, the cover having a front part and a rear part connected by an articulation; the front part of the cover being attached to the tear-out section of the base at a first attachment area, so that when the front part is fully rotated around the articulation, the front part is substantially parallel to the cover and the tear-out section is removed from the base to permit access to the bottle; and, the rear part of the cover being attached to the flanged cap outside the tear-out section at a second attachment area.

An advantage of this arrangement is that easy and continuous access to the bottle is provided after the front part is lifted-up.

Another advantage is that if the front part is pulled even further, the entire closure can be easily removed from the bottle.

Within the scope of the present invention it is also provided that the front part of the cover which extends over the tear-out section can engage the stationary rear part of the cover after the front part is lifted up and rotated around the articulation.

An advantage of the present invention then is that after the front part of the cover, along with the tear-out section torn out along the weakened line in the region of the mouth of the medicine bottle, is lifted up, it may engage with the rear part. This prevents the front part of the cover from possibly springing back due to the articulation, and provides a clear opening of the flanged cap for insertion of a syringe.

In accordance with one advantageous arrangement of the present invention, it is provided that the weakened line completely surrounds the tear-out section in the region of the mouth of the medicine bottle. By the preferably circular development of the weakened line, which a forms a full circle, the tear-out section is completely separated from the base of the flanged cap upon lifting up the front part of the cover. Since the tear-out section is then no longer connected to the base of the flanged cap, it cannot cause an elastic springing back in the direction of its original position. With this arrangement, the handling of the closure for the medicine bottle is substantially improved: operating personnel no longer need to hold the front cover part in its open position while, for example, a syringe is introduced into the medicine bottle for removal of its contents.

The front and rear part of the cover may also be provided with snap fastener elements which can be brought into engagement with each other. This arrangement, in which the snap fastener elements can be brought into frictional or form-locked engagement with each other, makes it possible to use the medicine bottle in any desired position since the front cover part is reliably held in its open position on the rear cover part—even if the medicine bottle is upside down. If the closure for the medicine bottle is developed in such a manner that the weakened line is not closed upon itself and continues to be partially connected to the base of the flanged cap after opening the front part of the cover, the connection between tear-out section and base will not impair the handling of the closure. Even in this case, the front, swung-back part will be reliably held on the rear part of the cover by the snap fastener elements.

The cover can made of a polymeric material, which allows for simple, financially cost-favorable production. Furthermore, a good seal is achieved in the region of the places where the cover rests against the flanged cap or penetrates it. Such closure caps assure a germ-free sealing between plastic cover and the flanged cap, even with small bottle diameters.

The articulation between the front part of the cover and the rear part of the cover can be formed by a film hinge. The function of such an articulation is completely sufficient for the present application since the articulation is not subject to a large number of load changes. This arrangement results in a closure having only a few parts, which allows favorable production from the standpoint of manufacturing technology and economy. Due to the small number of parts of different material, the closure of the invention can be reused again without problems.

A reliable form-locked fastening of the cover on the base of the flanged cap can be achieved with the following arrangement: the flanged cap at the first and/or the second attachment area is provided with at least one opening which the cover engages with a projection which passes through the opening and thickens below the opening. In accordance with the present invention, at both attachment areas the projection of the cover preferably engages in each case one opening.

Due to the form-locked connection of the cover and flanged cap in the region of the first attachment area, the tear-out section can be torn off along the weakened line from the base of the flanged cap with the exertion of only small forces on the part of the operating personnel.

The second attachment area which is arranged in the rear part of the cover is formed in the same way as the first attachment point: by a projection on the cover which engages in form-locked manner through an opening. For reasons of space, the second attachment area in the rear cover part is preferably made smaller than the first attachment area and facilitates the entire tearing off of the flanged cap from the bottleneck.

The closure can be removed from the medicine bottle in a particularly simple manner if the flanged cap is provided with second weakened lines which are adjacent on both sides to the second attachment area in a circumferential direction and extend substantially radially outward proceeding from the weakened line. The second weakened lines extend from the weakened line which defines the tear-out section via the base of the flanged cap up into the region of the flange which extends over the bottle neck of the medicine bottle. The second weakened lines can extend in an axial direction along the flange down to the edge thereof. In this case, a tearing-off of the entire flanged cap requires particularly small forces.

In accordance with another arrangement, only one of the second weakened lines is extended down to the edge region of the flange, the second of the second weakened lines terminating approximately in the center of the axial extent of the flange. Any possibility of the unintentional tearing off of the flanged cap is therefore substantially excluded and the cover as well as the tear-out section remain connected to the flange in the region of the second of the weakened lines, which does not entirely separate the flange. Handling therefore is simplified since the number of parts removed from the bottle neck is reduced.

On the side opposite the second attachment area, the flanged cap can be provided with a third weakened line which extends radially outward from the weakened line. The third weakened line is preferably arranged in such a manner that it is associated with the first attachment area on the side facing away from the second attachment area. The third weakened line allows simple folding up of the flanged cap when the tear-out section and a segment-shaped section which is delineated by the second weakened lines have been separated out of the flange. The flange, which extends in an axial direction, then forms a film hinge which connects the two partial regions of the flanged cap to each other. By providing this problem-free removal of the metallic flanged cap, handling is simplified and the risk that operating personnel are injured upon the separation of the individual elements is minimized.

Proceeding from the weakened line which delineates the tear-out section, the second and third weakened lines can be extended at least up to the outer circumference of the flanged cap.

For the protection of the flanged cap and for the precise spatial association of flanged cap and cover, the cover, which extends over the flanged cap, is provided with a collar. On the side of the first attachment area facing away from the articulation, the collar of the cover can be profiled in order to provide an opening tab.

BRIEF DESCRIPTION OF THE DRAWINGS

The closure of the present invention will be explained in greater detail below with reference to the following drawings.

DETAILED DESCRIPTION OF THE PRESENT INVENTION

Figure 1:
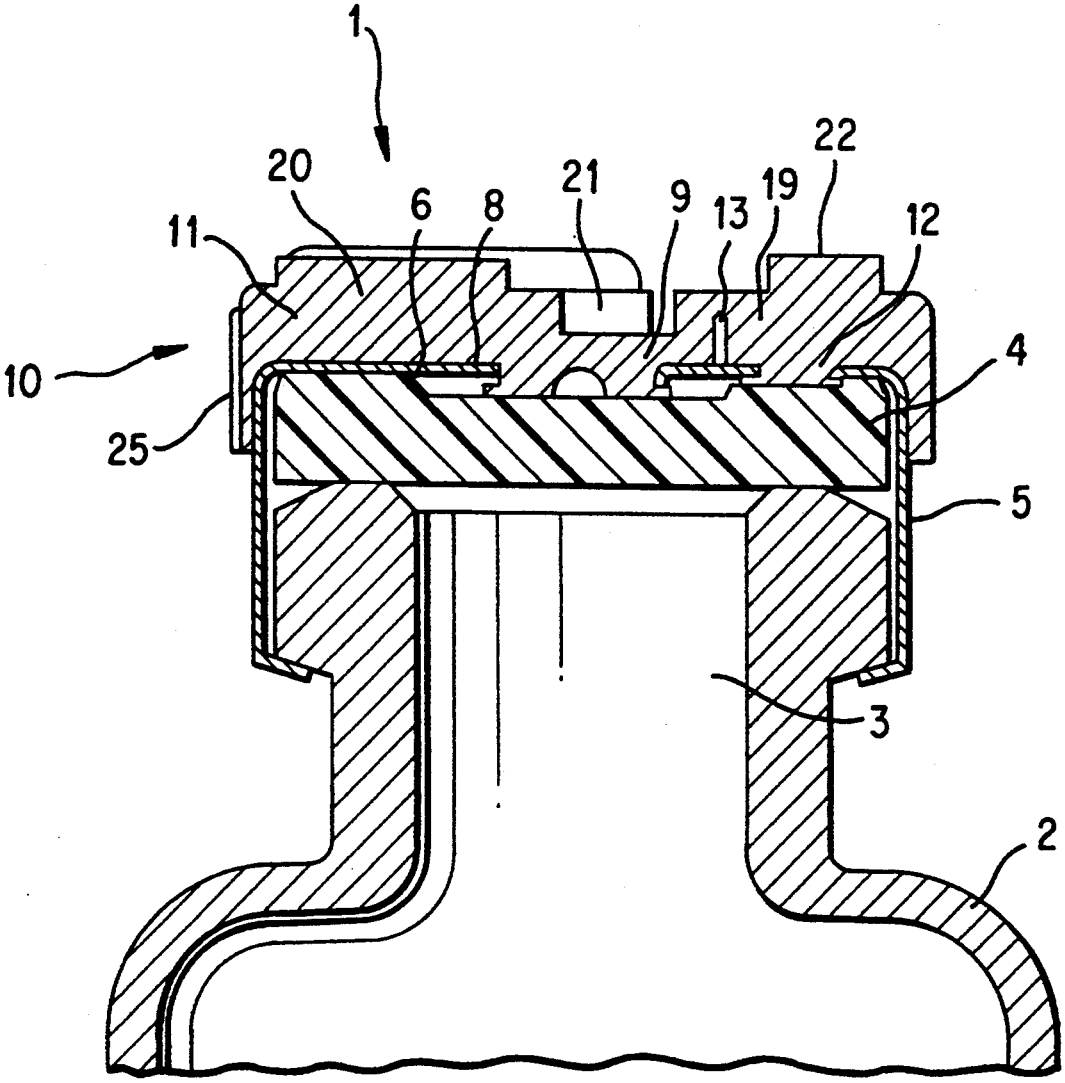
FIG. 1 shows a sectional view of a medicine bottle closed by the closure of the invention.

FIGS. 1 to 4 show a closure 1 for a medicine bottle 2. The closure 1 has a sealing element 4 of polymeric material which closes off the mouth 3 of the medicine bottle 2 in a germ-free manner. In this embodiment, a disk is provided as the sealing element 4. However, it is possible to have embodiments of the sealing element which differ from the disk as shown. For instance, the sealing element 4 may be a disk with a plug-shaped widening in the direction of the mouth 3 of the medicine bottle 2 so as to center the sealing element 4. The sealing element 4 is pressed down by a metallic flanged cap 5, thereby providing an initial axial sealing tension for the sealing element 4 against the mouth 3 of the bottle neck. The flanged cap in this embodiment consists of aluminum.

The flanged cap 5 is provided with a central tear-out section 8 which is defined by a weakened line 7. The tear-out section 8 has an opening 15 which a cover 11 with a projection 17 engages in form-locked manner. The opening 15, into and under which the projection 17 engages, forms a first attachment area 9.

To provide for the removal of the tear-out section 8, the cover 11 is developed as a handle element 10; the cover 11 fully covering the flanged cap 5. Outside the central tear-out section 8, a base 6 of the flanged cap 5 and cover 11 are connected by a second attachment area 12 which is also formed by an opening 16 and a projection 18, the projection 18 extending in a form-locked manner through the opening 16.

An articulation 13, which is developed as a film hinge, is arranged between the first and second attachment areas 9 and 12 respectively, the articulation being formed on the side of the cover 11 furthest away from the medicine bottle 2 by a recess in the cover 11. The articulation 13 extends transverse to an imaginary connecting line 14 which connects the first and second attachment areas 9 and 12 respectively to each other.

The cover 11 consists of a front part 20, which extends over the tear-out section 8, and of a rear part 19. The surface of the cover 11 facing away from the medicine bottle 2 is developed in such a manner that the front part 20 and the rear part 19 of the cover 11 are provided with snap fastener elements 21, 22. After the front part 20 is lifted up and the tear-out section 8 removed, the snap fastener elements 21, 22 can be brought into engagement with each other by the rotation of the front part 20 around the articulation 13. The cover 11 extends over the flanged cap 5 with a collar 25 which functions as an opening tab.

Figure 2:
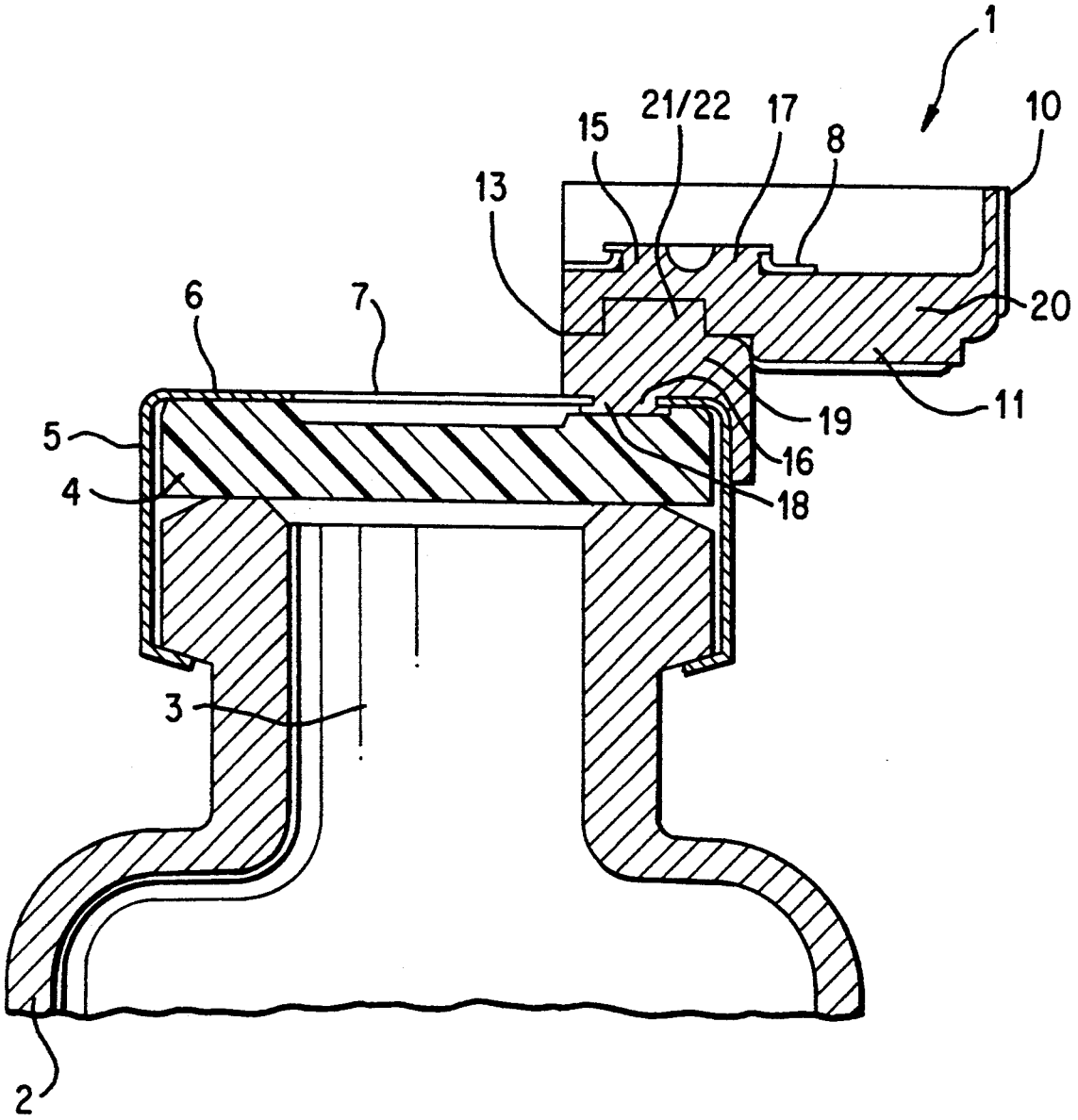
FIG. 2 shows the first opening phase of the closure cap of FIG. 1, which allows for insertion of a syringe into the bottle.

In FIG. 2, the tear-out section 8 has been removed from the base 6 and has been rotated around the articulation 13 together with the front part 20 of the cover 11. The front part 20 of the cover 11 thus is engaged with the rear part 19 of the cover 11. The sealing element 4 continues to be pressed in sealing manner by the flanged cap 5 onto the mouth 3 of the medicine bottle 2. Through the opening in the base 6 formed by the removal of tear-out section 8, the content of the medicine bottle 2 can be removed by means of a syringe which is pushed through the sealing element 4.

Furthermore, the tear-out section 8 can be placed back again, thereby closing the medicine bottle in a provisional manner by re-engaging the base 6 in the region of the weakened line 7.

Figure 3:
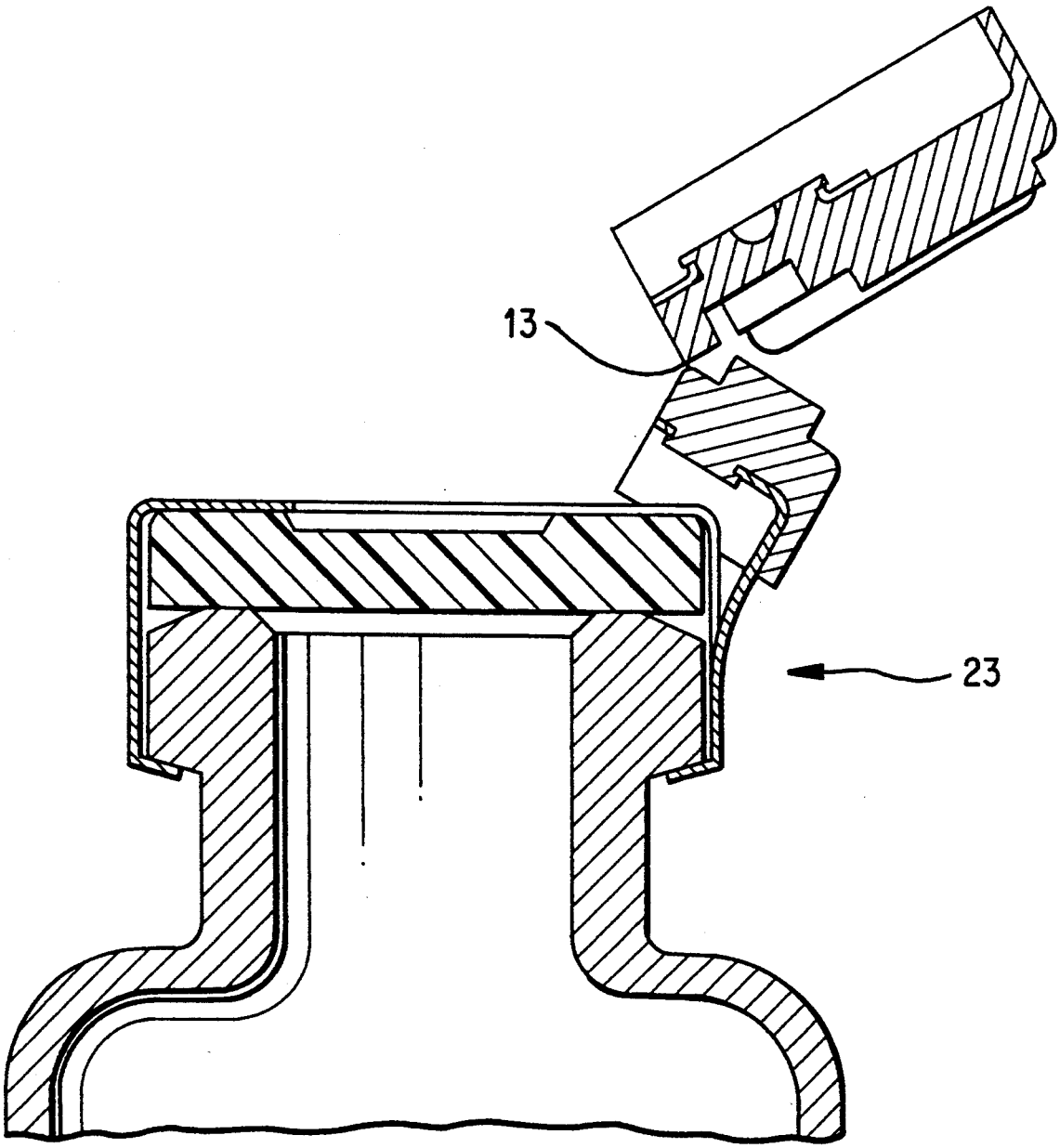
FIG. 3 shows the second opening phase, which allows for the complete removal of the flanged cap.

If the medicine bottle 2 has been emptied and is to be reused or if the content of the medicine bottle 2 is to be poured out, the entire closure 1 must be removed from the medicine bottle 2. This process is shown in FIG. 3. Proceeding from the lifted-up front part 20 of the cover 11 of FIG. 2, the cover 11 is pulled further in the opening direction. Due to the form-locked connection of the rear part 19 of the cover 11 to the flanged cap 5, the flanged cap 5 in the region of its flanged edge is then split through in at least one place. Once the flanged region is split, the cover 11 and the flanged cap 5 can be completely removed from the bottle neck. The sealing element 4 is then exposed and can also be reused.

Figure 4:
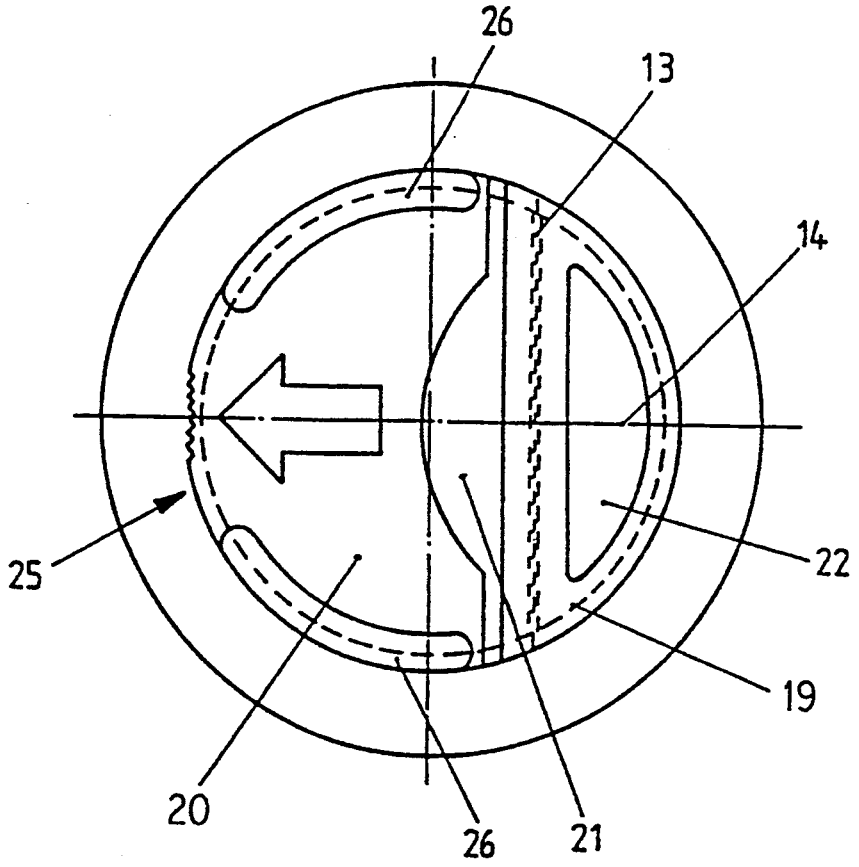
FIG. 4 shows a top view of the closure of FIG. 1.

FIG. 4 is the top view of the showing of FIG. 1. The collar 25 of the cover 11 which extends over the flanged cap 5 is profiled over a partial region of its circumference in order to facilitate handling. Thickened areas 26 are arranged in the circumferential edge region of the cover 11 which, upon the opening of the closure 1, prevent the sealing element from being acted upon by possible impurities which are present on the surface of the cover. The front and rear parts 20 and 19 respectively of the cover 11, which are connected to each other by the articulation 13, have snap fastener elements 21, 22 which are adapted to the circumference of the cover.

Figure 5:
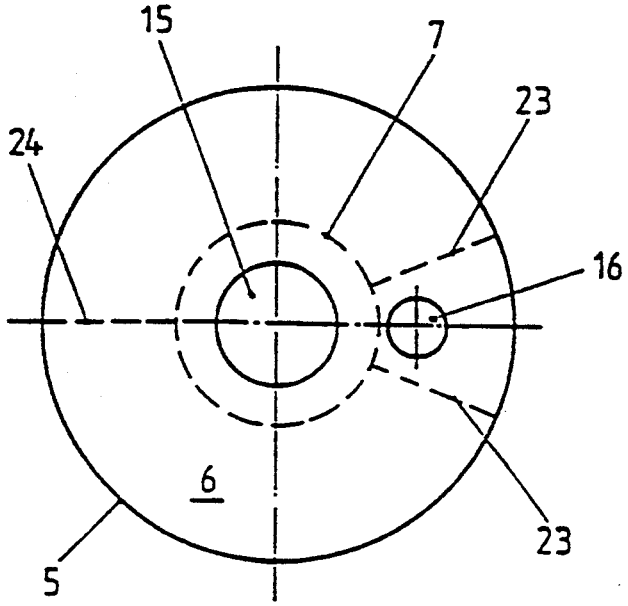
FIG. 5 shows a top view of an embodiment of a flanged cap as used in the preceding drawings.

In FIG. 5, the flanged cap 5 is shown as individual part. In the region of the first attachment area 9, it is provided with an opening 15, the opening 15 being completely surrounded in this embodiment by the weakened line 7. In the region of the second attachment area 12, there is provided another opening 16 which is surrounded by second weakened lines 23. The latter extend substantially radially in the direction of the flange edge. On the side of the flanged cap 5 opposite the second weakened lines 23, there is a third weakened line 24 which, proceeding from the weakened line 7, extends radially up into the edge region of the base 6.

Figure 6:
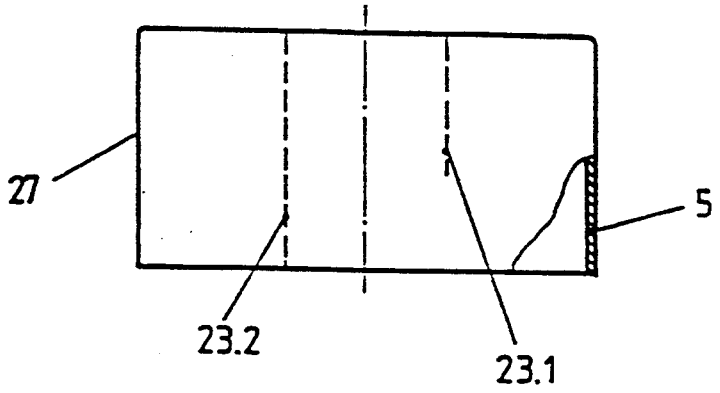
FIG. 6 shows the flanged cap of FIG. 5 in a side view from the right.

In FIG. 6, the flanged cap 5 of FIG. 5 is shown in a side view, seen from the right. It can be noted that the second weakened lines 23 extend into the region of the flange section 27 and extend in this region in an axial direction. One of the weakened lines 23.1 extends down only to approximately the center of the flange section 27, while the other weakened line 23.2 extends completely over it.

If the front part 20 of the cover 11 is brought into engagement with the rear part 19 of the cover by the snap fastener elements 21, 22 after being swung back around articulation 13, then the tear-out section 8 is removed and the sealing element 4 is exposed for removal of the contents of the medicine bottle 2. If the closure is to be removed completely from the medicine bottle, then the front part 20 of the cover 11 is moved further in the direction of opening and it carries along with it, via the articulation 13 and the second attachment area 12, that part of the base 6 which is defined by the second weakened lines 23. At this point, the flange edge 27 of the flanged cap 5 is thus split through in at least one place, so that the latter can be removed from the bottle neck in the following manner: the flanged cap 5 is pulled apart in the region of its split so that the third weakened line 24, proceeding from the weakened line 7, is torn in the radial direction with the exertion of only a small force. The flange edge 27 of the flanged cap 5 in the region of the third weakened line 24 serves, upon the bending open, as a film hinge-like articulation. The closure 1 can now be removed from the medicine bottle 2 without any problems.

It should be understood that the present invention is not limited to the exact structure herein disclosed; in particular, it is also contemplated that the closure might be useful in bottles which do not require a sealing element for sealing liquid.

What is claimed is:

1. A closure for a bottle comprising:

a flanged cap for covering a mouth of the bottle and having a base and a flange, the base having a tear-out section defined by a weakened line;

a cover disposed over the base, the cover having a front part and a rear part connected by an articulation;

the front part of the cover being attached to the tear-out section of the base at a first attachment area, so that when the front part is fully rotated around the articulation, the front part is substantially parallel to the rear part of the cover and the tear-out section is removed from the base to permit access to the bottle; and, the rear part of the cover being attached to the flanged cap outside the tear-out section at a second attachment area.

2. The bottle closure as recited in claim 1 wherein the flanged cap has a first opening within the tear-out section and the front part of the cover has a projection which engages the first opening.

3. The bottle closure as recited in claim 2 wherein the projection is thickened below the first opening.

4. The bottle closure as recited in claim 1 wherein the flanged cap has at least one second weakened line which extends from the tear-out section and substantially surrounds the second attachment area, so that when the second part of the base is pulled away from the flanged cap, the flanged cap separates along the second weakened line.

5. The bottle closure as recited in claim 4 wherein said at least one second weakened line comprises a plurality of weakened lines and at least one of the second weakened lines extends between the tear-out section and an edge of the flange.

6. The bottle closure as recited in claim 5 wherein another of the second weakened lines extends only partially over the flange.

7. The bottle closure as recited in claim 1 wherein the flanged cap has a second opening at the second attachment area and the rear part of the cover has a second projection which engages the second opening.

8. The bottle closure as recited in claim 7 wherein the second projection is thickened below the second opening.

9. The bottle closure as recited in claim 1 wherein the flanged cap has at least one third weakened line which extends radially outward from the tear-out section on the side opposite the second attachment area.

10. The bottle closure as recited in claim 1 wherein the articulation extends transverse to a line extending between the first and the second attachment areas.

11. The bottle closure as recited in claim 1 wherein the front part and the rear part of the cover each have fastener elements which can be brought into engagement with each other.

12. The bottle closure as recited in claim 1 wherein the cover is made of a polymeric material.

13. The bottle closure as recited in claim 1 wherein the articulation is formed by a film hinge.

14. The bottle closure as recited in claim 1 wherein the tear-out section can be re-inserted into the base.

15. A closure for a bottle comprising:

a sealing element for covering a mouth of the bottle;

a flanged cap disposed over the seal and having a base and a flange, the base having a tear-out section defined by a weakened line;

a cover disposed over the base, the cover having a front part and a rear part connected by an articulation;

the front part of the cover being attached to the tear-out section of the base at a first attachment area, so that when the front part is fully rotated around the articulation, the front part is substantially parallel to the rear part of the cover and the tear-out section is removed from the base to permit access to the seal.

16. The bottle closure as recited in claim 15 wherein the rear part of the cover is attached to the flanged cap outside the tear-out section at a second attachment area.

17. The bottle closure as recited in claim 16 wherein the flanged cap has at least one second weakened line which extends from the tear-out section and substantially surrounds the second attachment area, so that when the second part of the base is pulled away from the flanged cap, the flanged cap separates along the second weakened line.

18. The bottle closure as recited in claim 17 wherein said at least one second weakened line comprises a plurality of weakened lines and at least one of the second weakened lines extends between the tear-out section and an edge of the flange.

19. The bottle closure as recited in claim 16 wherein the flanged cap has at least one third weakened line which extends radially outward from the tear-out section on the side opposite the second attachment area.

20. The bottle closure as recited in claim 15 wherein the front part and the rear part of the cover each have fastener elements which can be brought into engagement with each other.

* * * * *